United States Patent [19]

Saito et al.

[11] Patent Number: 4,598,553

[45] Date of Patent: Jul. 8, 1986

[54] COMBUSTOR FOR GAS TURBINE

[75] Inventors: Isao Saito; Yoji Ishibashi; Takashi Ohmori; Yoshimitsu Minakawa; Michio Kuroda, all of Hitachi, Japan

[73] Assignee: Hitachi, Ltd., Tokyo, Japan

[21] Appl. No.: 375,582

[22] Filed: May 6, 1982

[30] Foreign Application Priority Data

May 12, 1981 [JP] Japan ..... 56-70149

[51] Int. Cl.[4] ..... F02C 1/00; F02G 3/00

[52] U.S. Cl. ..... 60/733; 60/137; 60/748

[58] Field of Search ..... 60/39.463, 39.465, 732, 60/733, 737, 738, 739, 746, 747, 748

[56] References Cited

U.S. PATENT DOCUMENTS

| | | | |
|---|---|---|---|
| 2,704,435 | 3/1955 | Allen | 60/746 |
| 3,703,259 | 11/1972 | Sturgess et al. | 60/748 |
| 4,054,028 | 10/1977 | Kawaguchi | 60/732 |
| 4,271,675 | 6/1981 | Jones et al. | 60/737 |
| 4,301,656 | 11/1981 | Stether | 60/737 |

FOREIGN PATENT DOCUMENTS

| | | | |
|---|---|---|---|
| 60323 | 5/1977 | Japan | 60/732 |
| 894054 | 4/1962 | United Kingdom | 60/748 |

*Primary Examiner*—Louis J. Casaregola

*Assistant Examiner*—Timothy S. Thorpe

*Attorney, Agent, or Firm*—Antonelli, Terry & Wands

[57] ABSTRACT

A gas turbine combustor comprises an inner cylinder provided with louvers in an outer periphery thereof, defines a head combustion chamber and a main combustion chamber located downstream of and greater in diameter than the head combustion. An outer cylinder surrounds the inner cylinder and defines an air passage therebetween. A first burner communicates with the head combustion chamber and supplies air with gaseous fuel, and a second burner being disposed in the air passage near the head combustion chamber and supplying air and gaseous fuel into the main combustion chamber. The second burner is formed with a plurality of air inlets by a plurality of vanes which are disposed in an annular passage and which swirl the air, and with gaseous fuel jet ports near the inner peripheries of the air inlets. When the flow rate of the supplied fuel is small, the fuel flows along an inner-peripheral surface of the second burner, and when the flow rate is large, the fuel from the air inlets moves from the inner-peripheral surface toward the outer-peripheral surface of the second burner so as to be mixed well with the air supplied into the main combustion chamber. Thus, the production of $NO_x$, CO, HC etc. can be decreased over the whole operating range of the turbine.

6 Claims, 9 Drawing Figures

COMBUSTOR FOR GAS TURBINE

The present invention relates to a gas turbine combustor adapted to decrease noxious gases produced during a combustion process, especially nitrogen oxides $NO_x$ and carbon monoxide (CO Noxious combustion gases such as $NO_x$, CO etc. are produced during the combustion of a gas turbine combustor and are contained in an exhaust gas thereby increasing air pollution. Among the harmful substances, $NO_x$ is produced in a combustion gas of high temperature rather than in a combustion region of the combustor. Therefore, a suppression in the production of $NO_x$ may be realize by lowering the temperature of the high-temperature combustion gas. As a measure for decreasing $NO_x$, there has been known a dry method in which a so-called thin combustion at low temperatures is effected by supplying excess combustion air. This method exploits air for combustion, and it can decrease $NO_x$ considerably effectively when uniform low-temperature combustion is realized in the combustion process.

On the other hand, CO is produced during the combustion process and is attributed to insufficient air and by overcooling due to an excess air supply, so an uncombusted component (CO) develops. In the gas turbine, CO is generated by the latter aspect attributable to the overcooling in the combustion process.

Accordingly, when $NO_x$ is reduced by the thin low-temperature combustion method, overcooling is liable to occur, resulting in an increased quantity of production of CO. In the gas turbine combustor adopting the thin low-temperature combustion method, the decrease of $NO_x$ and that of CO, contradictory to each other, must be simultaneously realized. It is accordingly an important point for decreasing both $NO_x$ and CO that flames are uniformly cooled effectively by the use of the least possible excess air and that overcooling be prevented.

In order to simultaneously decrease the $NO_x$ and CO, a two-stage combustion system has been developed which employs a combustor so constructed that in an inner cylinder is disposed an outer cylinder, with the combustor including a head combustion chamber and a main combustion chamber larger in diameter than the head combustion chamber. Gaseous fuel is supplied into the head combustion chamber and combusted therein, while in the main combustion chamber, swirling air and fuel are supplied to flames formed in the head combustion chamber so as to perform a low-temperature thin combustion. In this combustor, the combustion is the head combustion chamber is carried out from ignition to a high load operation of the turbine, while in the main combustion chamber, the combustion is begun by supplying the fuel into the swirling air when the load operation of the turbine has been started. A disadvantage of this proposed combustor resides in the fact that the quantities of CO and hydrocarbon (HC) representing an uncombusted component increase during the partial load operation of the combustor from the starting of the load operation till the rated load operation.

In a gas turbine combustor, it is necessary to enhance the combustion performance over the wide operating range from the ignition to the rated load and to decrease $NO_x$ and CO concentration. In addition, it is important to the enhancement of combustibility to eliminate the production of large quantities of CO and HC during the partial load operation of the combustor.

An object of the present invention is to provide a combustor of the two-stage combustion system which can sharply reduce CO and HC over the whole operating range of a turbine without adversely affecting a decrease in the production of $NO_x$.

A combustor for a gas turbine according to the present invention comprises a head combustion chamber, and a main combustion chamber located downstream thereof. In the head combustion chamber, air and fuel are supplied for the purpose of flame formation, while in the main combustion chamber, air and gaseous fuel for main combustion are externally supplied into the flames from the head combustion chamber and a combustion process is effected. Ports, for supplying the air and gaseous fuel for combustion into the main combustion chamber, are provided in proximity to the head combustion chamber, and ports, for supplying the gaseous fuel into the main combustion chamber, are provided in an air flow for the main combustion into the main combustion chamber and near the flames side. When a supply of gaseous fuel is small, the fuel flows inside the air flow for the main combustion and comes into contact with the outer periphery of the flames, and when the quantity of fuel supplied is large, most of the supplied fuel traverses the air flow and mixes well therewith and then comes into contact with the flames. Thus, even when the fuel is of small quantity, it is well combusted to reduce uncombusted gases, and when the fuel is of large quantity, it mixes well with the air and then contacts the flames, so that $NO_x$ is reduced without forming high-temperature regions.

Other objects and features of the present invention will become apparent from the following description taken with reference to the drawings, in which.

Figure 1:
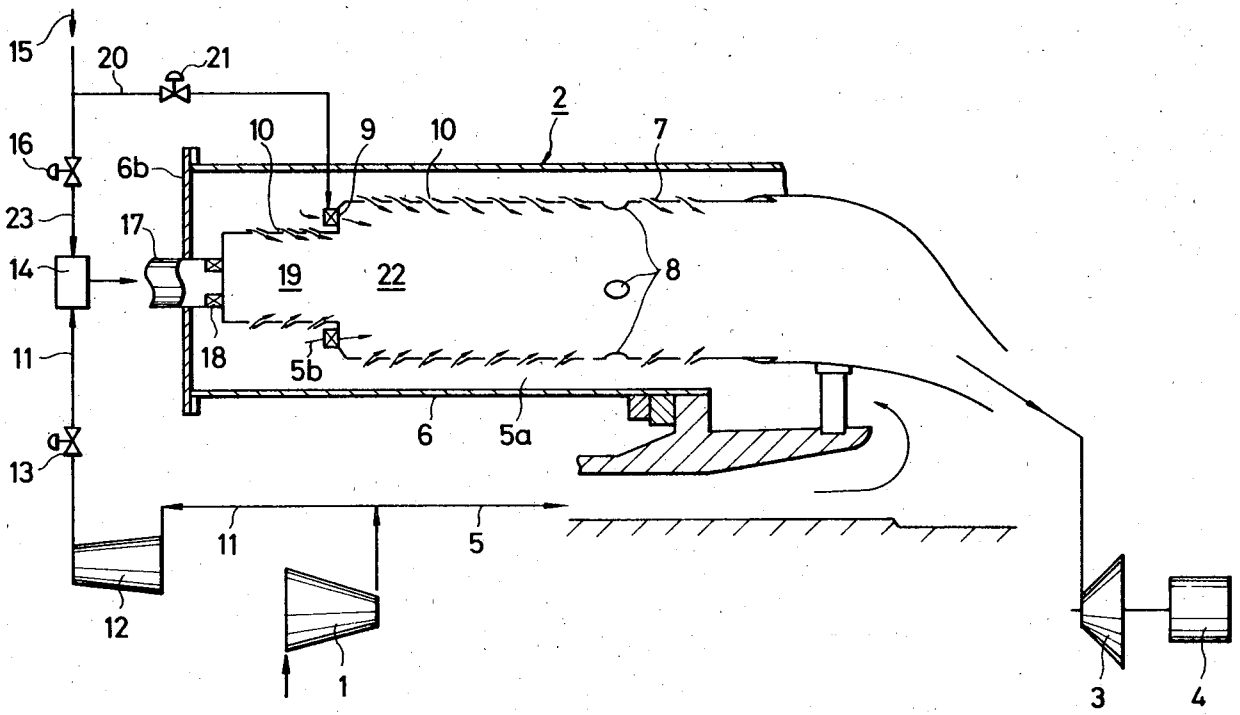
FIG. 1 is a partially schematic vertical cross sectional view of a gas turbine combustor constructed in accordance with the present invention.

Referring now to the drawings wherein like reference numerals are used throughout the various views to designate like parts and, more particularly, to FIG. 1, according to this figure, a gas turbine includes a compressor 1, a combustor generally designated by the reference numeral 2, a turbine 3 and a load portion 4. The combustor 2 includes an inner cylinder 7, provided with air holes or louvers 10 in an outer periphery thereof, an outer housing 6, surrounding the inner cylinder 7 at a spacing therefrom, an end plate 6*b*, fixed to an end of the outer housing 6, a first-stage swirl burner 17, disposed at an end of the inner cylinder 7 in a manner so as to penetrate through the end plate 6*b*, and a second-stage swirl burner 9, disposed on the inner cylinder 7 in such a manner so as to be disposed downstream of the first-stage swirl burner 17. The portion of the inner cylinder 7 defines a head combustion chamber 19 of a diameter smaller than a diameter of a main combustion chamber 22 formed by the inner cylinder 7 downstream of the head combustion chamber 19. The second-stage swirl burner 9 is mounted at the joint between the head combustion chamber 19 and the main combustion chamber 22.

A portion or compressed air is branched from the compressor 1 through a bypass 11 of an air passage 5 into a boost-up compressor 12, where the compressed air is further compressed, and the boosted air from the compressor 12 is introduced into a premixing chamber 14 through a control valve 13. A gaseous fuel 15 is introduced into the premixing chamber 14 through a fuel passage 23 having a control valve 16 and is mixed with the compressed air therein. The resulting fuel/air mixture is injected into the head combustion chamber 19 from the first-stage swirl burner 17 having a swirler 18, and is combusted therein. Such preliminary mixing and combustion is carried out for the whole operating range extending from the ignition to the high load operation of the combustor.

After the ignition, at the time when an operation bearing the load 4 of the turbine 3 has been started, or at the time of a partial load of, for example, ½ load, a control valve 21, incorporated in a fuel passage 20 branched from the fuel passage 23, is opened, so as to begin the supply of the gaseous fuel for the second-stage swirl burner 9.

From the ignition to the high load operation, the greater part of the compressed air from the compressor 1 is introduced through the air passage 5 into an annular passage 5*a* defined between the outer housing 6 and the inner cylinder 7, and, from the annular passage 5*a* introduced into the inner cylinder 7 through the cooling holes 10, the second stage swirl burner 9, and thinning air ports 8 which are provided on or in the inner cylinder 7.

By performing the preliminary mixing and combustion, in which the air and the fuel are preliminarily mixed before combustion, in the head combustion chamber 19, a sharp decrease of $NO_x$ can be achieved with a small quantity of excess air, that is, while decreasing the quantity of production of CO.

Figure 2:
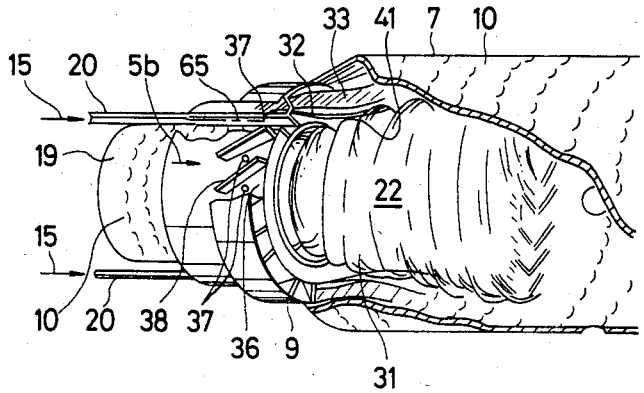
FIG. 2 is a perspective view, partly broken away, of an inner cylinder showing a fuel supply structure for a main combustion chamber in an embodiment of the present invention and the state of flame formation.

However, in the combustor of this construction, and also in another combustor in which fuel and a small quantity of excess air are fed into the head combustion chamber 19 and combusted therein without performing the premixing, a problem arises in that CO and an uncombusted component (HC) are produced in large quantities in the process in which the fuel is begun to be gradually supplied from the second-stage swirl burner 9 when the rated load operation is finally reached. To solve this problem, in accordance with the present invention, as shown in FIGS. 2, 3, the fuel 15 supplied to the second-stage swirl burner 9 is injected into swirling air flows for main combustion 33 from positions which are near the head combustion chamber 19.

More specifically, a fuel receiver or reservoir 65, in the shape of a double cylinder closed at both ends, is disposed on the inner-peripheral side of the annular second-stage swirl burner 9, provided with a plurality of air swirling vanes 38 along an outer periphery thereof. Pipes or lines 20 for supplying the fuel are connected to the fuel receiver 65, with an outer cylinder of the fuel receiver 65, that is, the inner cylinder portion or inner wall surface 36 of the swirl burner 9 being provided along a periphery thereof with a large number of ports 37 serving as fuel injection ports.

In this arrangement, the fuel 15 fed through the pipes 20, is introduced into the fuel receiver 65 and is injected from the fuel injection ports 37 toward a swirling air flow 5*b* for the main combustion chamber passing through the swirl burner 9. In case the flow rate of the fuel is small, the injection speed of the fuel is low, so that as shown in FIG. 2, fuel flows 32 penetrate into the swirling air flows 33 with short distances and mostly advance along the plane of the inner cylinder portion 36 of the swirl burner 9. With a small flow rate of the fuel, therefore, especially the outer-peripheral portion of the high temperature premixing-combustion flames 31 from the head combustion chamber 19 and the fuel flows 32 are brought into contact substantially in an area designated so as to sustain the combustion process. Further, the main stream of the swirling air flows 33, downstream of the swirl burner 9, flows in such a manner so as to envelop the premixing-combustion flames 31, and hence, a state does not develop in which the combustion flames are overcooled. In particular, the production of CO and HC in the process in which the fuel is introduced from the second-stage swirl burner 9 and is gradually increased, can be suppressed to a very low level.

Figure 3:
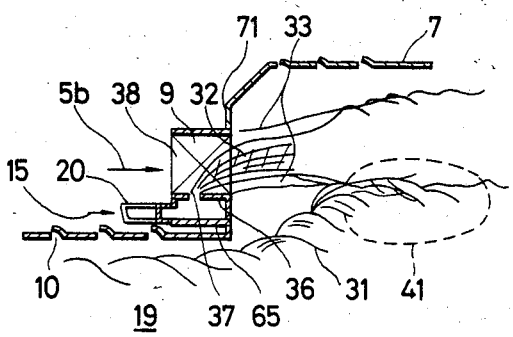
FIG. 3 is an enlarged view of a detail in FIG. 2, and shows another state of flame formation.

On the other hand, in the rated load state, as illustrated in FIG. 3, the quantity of injection of the fuel from the fuel injection ports 37 increases, and the injection speed rises, so that the penetration distance into the swirling air flow 5*b* is increased. During the rated load operation, therefore, the fuel flows 32 are supplied to the central and to outer side of the second stage swirl burner 9 and mixed with the swirling air, so that the decrease of $NO_x$ can also be achieved.

Figure 4:
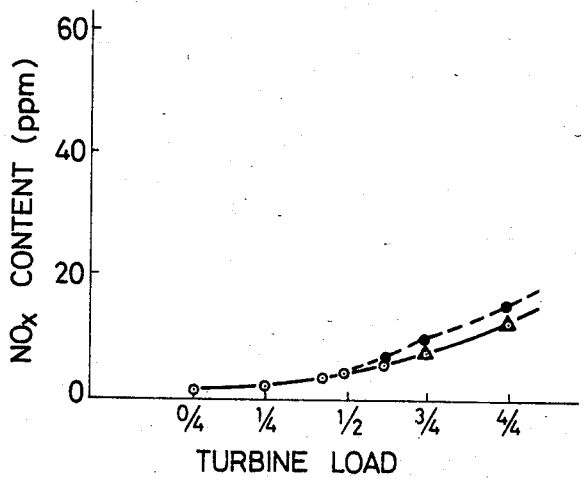
FIG. 4 is a graphical illustration of relationships between the $NO_x$ content and the turbine load, depending upon combustors.
Figure 5:
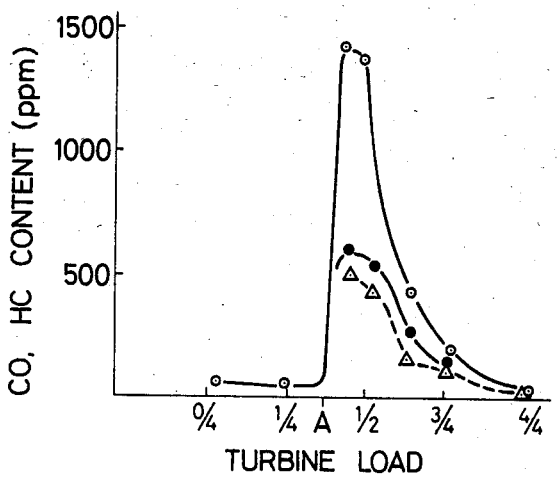
FIG. 5 is a graphical illustration of relationships of the combustors between the CO and HC contents and the turbine load.

FIG. 4 illustrates by comparison the $NO_x$ contents in exhaust gases versus the turbine load, with the symbol representing a fuel supply from the inner side, i.e., the side close to the head combustion chamber 19 as in FIGS. 2 and 3, and and the symbol ⊚ representing the fuel the fuel supply from the outer side. In FIG. 5, illustrating a comparison between the CO and HC contents the symbol • corresponds to the fuel supply from the inner side, and the symbol ⊚ corresponds to the fuel supply from the outer side. As apparent from FIG. 5, the contents of CO, HC etc. during a partial load (beyond the point A at which the fuel supply from the second-stage swirl burner 9 is started) can be sharply reduced by supplying the fuel from the inner side.

During the rated load operation, however, when the fuel is supplied from the inner side, the $NO_x$ content tends to somewhat increase as compared with that in the case of the fuel supply from the outer side. This is attributed to the fact that, since the premixing-combustion flames 31 from the head combustion chamber 19 interfere with the flames from the second-stage swirl burner 9, a spot of high temperature appears in the contact area 41, so the quantity of production of $NO_x$ in this part increases.

Figure 6:
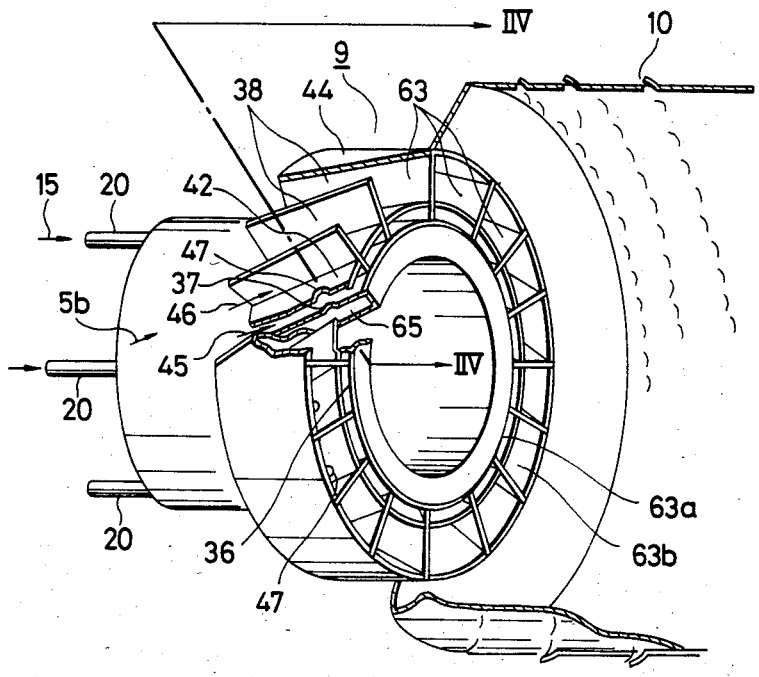
FIG. 6 is a perspective view, partly broken away, showing a fuel supply structure for a main combustion chamber in accordance with another embodiment of the present invention.
Figure 7:
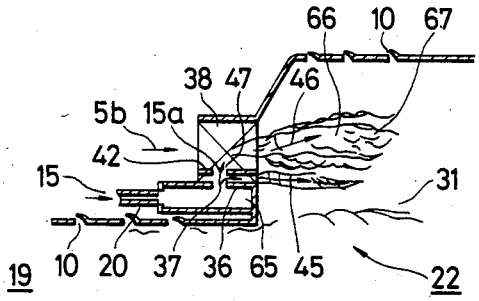
FIG. 7 is a cross-sectional view taken along a line IIV—IIV in FIG. 6.

As shown in FIGS. 6 and 7, to suppress suppress an increase in the quantity of $NO_x$ produced, a swirling air passage 63, is formed of an inner cylinder portion 36 extending axially of a swirl burner 9, an outer cylinder portion 44, disposed coaxial with the inner cylinder portion 36, and swirling vanes 38, disposed between the inner and outer cylinder portions 36, 44 and in a peripheral direction thereof. The swirling air passage 63 is provided with partition plates 42 for dividing the swirling air passage 63 in the radial direction, with each partition plate 42 being provided with a port 47 serving as an air passing port, in a position opposed to an air jet port 37 of the inner cylinder portion 36. The partition plates 42 are concentric with the inner and outer cylinders of the second stage burner 9 and are mounted near the inner cylinder portion 36, whereby each section of the swirling air passage 63 is radially divided into a narrow inner passage 63*a* and a broad outer passage 63*b*. Thus, an air flow 5*b* is branched into an air flow 45 of small flow rate passing through the inner passage 63*a* and an air flow 46 of large flow rate passing through the outer passage 63*b*.

With such arrangement, when the fuel from the second-stage swirl burner 9 is of small quantity, the fuel contacts the premixing-combustion flames 31 from the head combustion chamber 19. On the other hand, near the rated operation in which the fuel quantity becomes large, the degree of mixing between the premixing-combustion flames 31 and the fuel lessens, and both CO and $NO_x$ can be decreased more than in the foregoing embodiment as apparent from the discussion hereinbelow.

When fuel is injected in a manner to orthogonally intersect an air flow, an arrival distance by which the fuel penetrates into the air flow is, in general, expressed by the following equation:

$$Y_{jet} = 2.2\left(\frac{v_f \cdot \rho_f}{v_a \cdot \rho_a} - 0.1\right)^{0.68} \times d_f,$$

wherein $Y_{jet}$ denotes the arrival distance, $v_f$ and $\rho_f$ and $v_a$ and $\rho_a$ denote the speeds and densities of the fuel and air flow, respectively, and $d_f$ denotes the diameter of the injection port of the fuel. As understood from the above equation, the arrival distance $Y_{jet}$ increases with the fuel injection speed $v_f$ and with the injection port diameter $d_f$. That is, in case the fuel 15 is of small quantity, the fuel injection speed $v_f$ becomes low, and hence, the value of the arrival distance $Y_{jet}$ is small. Conversely, when the fuel flow rate becomes large, the fuel injection speed $v_f$ increases, so that the value of the arrival distance $Y_{jet}$ becomes large. In case of the combustor of the present embodiment, the injection speed $v_f$ of the fuel changes from O m/s to about 100 m/s. When the diameter $d_f$ of the injection port 37 is 3 mm, the arrival distance of the fuel changes over 0–30 mm or so.

Taking the above facts into consideration, the partition plates 42 should desirably be set so that a penetration distance of the fuel 15 may lie inside the partition plates 42 in an operation of the combustor up to about $\frac{1}{2}$–$\frac{3}{4}$ load in which the fuel flow rate is low.

In the combustor of the present embodiment, when the injection quantity of the fuel 15 is small, the fuel 15 does not penetrate into the swirling air flow. Therefore, the fuel 15 flows only inside the partition plates 42 and contacts the premixing-combustion flames 31, so that the production of the uncombusted component (HC) and CO can be suppressed. In addition, when the fuel 15 is supplied in large amounts as occurs during rated load operation, most of the fuel 15 passes, as shown at 15*a* through the fuel port 47 provided in the partition plate 42 and mixes into the swirling air flow 46 running outside the partition plate 42, as illustrated in FIG. 7. Since, at this time, only the air flow 45 runs inside the partition plates 42, the flames in the main combustion chamber 22 are in such a shape that the premixing-combustion flames 31 from the head combustion chamber 19 and flames 67 from the second-stage swirl burner 9 are separated by the air flow 45 passing inside the partition plates 42. Accordingly, the air flow 45 enters the high-temperature region at a point of intersection between the premixing-combustion flames 31, and the fuel 15 appears as though the partition plates 42 were not present. Therefore, the high-temperature region can be effectively quenched.

In FIGS. 4 and 5, the symbol △ represents a construction provided with the partition plates 42 and and with the fuel supplied from the inner side. As shown in FIGS. 4 and 5, due to the provision of the partition plates 42, the $NO_x$ content during the rated load operation can be decreased, and the CO and HC contents during the partial load operation are suppressed.

Figure 8:
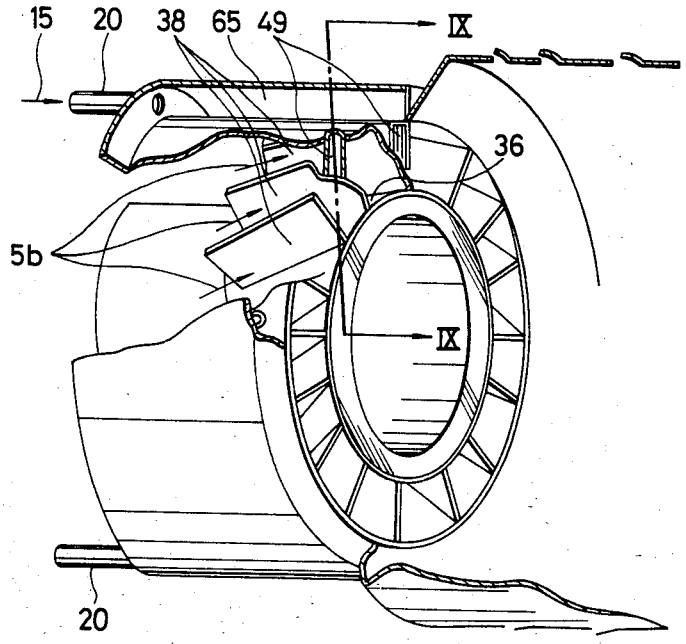
FIG. 8 is a perspective view, partly broken away, showing a fuel supply structure for a main combustion chamber in accordance with still another embodiment of the present invention.
Figure 9:
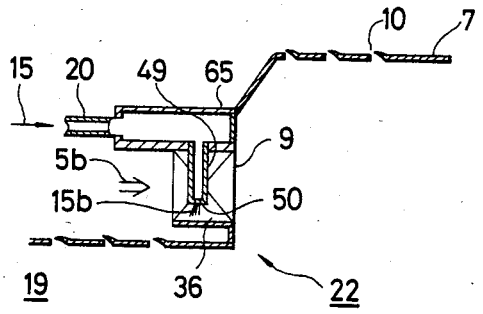
FIG. 9 is a cross-sectional view taken along a line IX—IX in FIG. 8.

While, in the foregoing embodiments, the fuel is supplied from inside the swirl burner 9, an arrangement as shown in FIGS. 8 and 9 may be adopted as well. More specifically, a fuel receiver 65 is disposed outside the second-stage swirl burner 9. A plurality of fuel supply pipes 49 are mounted in such a manner so as to extend inward toward the axis of the combustor from the fuel receiver 65 and with fuel jet ports 50 facing the outer surface of the inner cylinder portion 36 of the swirl burner 9, in other words, the plane of the swirling air passage close to the head combustion chamber 19. Thus, fuel 15*b* from the fuel supply pipes 49 collides against the outer surface of the inner cylinder portion 36. With such arrangement, when the quantity of the fuel 15 is small, the fuel 15*b*, injected from the fuel jet ports 50, flows along the outer surface of the inner cylinder portion 36 and is introduced into the main combustion chamber 22. On the other hand, when the quantity of the fuel 15 is large, the injected fuel 15*b* collides against the outer surface of the inner cylinder portion 36 at high flow speed, whereupon it flows into the main combustion chamber 22 along the side wall surfaces of the swirling vanes 38. With this arrangement, both CO and $NO_x$ can be decreased, but the $NO_x$ decreasing effect is somewhat inferior to the effect achieved with the partition plates. However, a decrease of about 60% can be achieved as compared with the $NO_x$ content in the combustor in which any measure for decreasing $NO_x$ is not taken.

In case of disposing the fuel supply pipes 49 in this manner, to locate the fuel jet ports 50 near the outer surface of the inner cylinder portion 36 is effective for causing the fuel to flow along the outer surface of the inner cylinder portion 36 with a small fuel quantity and for causing it to flow along the inner wall surfaces of the swirling vanes with a large fuel quantity.

While, in the foregoing embodiments, the premixed air and fuel are fed into the head combustion chamber 19, air and fuel may well be individually fed into the head combustion chamber 19 and mixed therein so as to perform a thin combustion process.

As set forth above, according to the combustor of the present invention, due to the difference of the injection speed, dependent upon the flow rate of the fuel for the main combustion chamber, overcooling in the main combustion chamber particularly at the partial load is reduced, so that the quantities of production of CO and HC can be decreased. Simultaneously therewith, a uniform thin combustion process at low temperatures can be realized, so that a sharp decrease of $NO_x$ is possible.

What is claimed is:

1. A combustor for a gas turbine comprising:

inner cylinder means for defining a combustion chamber with a plurality of louvers for supplying air into said combustion chamber, said combustion chamber including a head combustion chamber and a main combustion chamber, said main combustion chamber being disposed downstream of said head combustion chamber and having a larger cross-sectional area than said head combustion chamber taken along a plane perpendicular to a longitudinal axis of said combustion chamber;

outer housing means for surrounding said inner cylinder means to form an air passage means communicating with said combustion chamber through said louvers;

first fuel supply means for supplying a gaseous fuel into said head combustion chamber;

first air supply means for supplying air for a combustion process into said combustion chamber, with fuel from said first fuel supply means being combusted in said head combustion chamber to form flames which flow into said main combustion chamber;

second air supply means arranged annularly and mounted adjacent to said head combustion chamber, for swirling and supplying air from said air passage means into said main combustion chamber so that air is injected substantially axially to the swirling air so as to surround the flames which flow into the main combustion chamber, said second air supply means comprises an inner cylinder extending coaxially of said inner cylinder means defining the combustion chamber, an outer cylinder surrounding said inner cylinder at a spacing therefrom, and a plurality of axially inclined vanes disposed in an annular space defined by said inner and outer cylinders and defining a plurality of air passages; and second fuel supply means for supplying gaseous fuel into said main combustion chamber, said second fuel supply means having a plurality of inlet ports arranged such that gaseous fuel is injected so as to flow inside of air flowing from said air passage means to said main combustion chamber to contact an outside of the flames at a low flow rate of gaseous fuel and traverses the air flow from said air passage means and mixes with the injected swirling air at a high flow rate of gaseous fuel, said second fuel supply means having a plurality of fuel inlet port means each of which is disposed in a portion of said air passages near said inner cylinder.

2. The combustor as defined in claim 1, wherein each of said plurality of fuel inlet port means includes a hole formed in said inner cylinder so that each fuel inlet port means opens to an interior of said air passages.

3. The combustor as defined in claim 2, wherein each of said plurality of fuel inlet port means comprises a pipe mounted on said outer cylinder and extending near said inner cylinder so that gaseous fuel is injected into the gas flow from near said inner cylinder.

4. A combustor for a gas turbine comprising:

inner cylinder means for defining a combustion chamber with a plurality of louvers for supplying air into said combustion chamber, said combustion chamber including a head combustion chamber and a main combustion chamber, said main combustion chamber being disposed downstream of said head combustion chamber and having a larger cross-sectional area than said head combustion chamber taken along a plane perpendicular to a longitudinal axis of said combustion chamber;

outer housing means for surrounding said inner cylinder means to form an air passage means communicating with said combustion chamber through said louvers;

first fuel supply means for supplying a gaseous fuel into said head combustion chamber;

first air supply means for supplying air for a combustion process into said combustion chamber, with fuel from said first fuel supply means being combusted in said head combustion chamber to form flames which flow into said main combustion chamber;

second air supply means, arranged annularly and mounted adjacent to said head combustion chamber, for swirling and supplying air from said air passage means into said main combustion chamber so that air is injected substantially axially to the swirling air, said second air supply means comprising an inner cylinder extending coaxially of said inner cylinder means defining the combustion chamber, an outer cylinder surrounding said inner cylinder at a spacing therefrom, and a plurality of axially inclined vanes disposed in an annular space defined by said inner and outer cylinders and defining a plurality of air passages, said second fuel supply means having a plurality of fuel inlet port means each of which is disposed in a portion of said air passages near said inner cylinder;

second fuel supply means for supplying gaseous fuel into said main combustion chamber, said second fuel supply means having a plurality of inlet ports arranged such that the gaseous fuel is injected so as to flow inside of air flowing from said air passage means to said main combustion chamber at a low flow rate of gaseous fuel and traverses the air flow from said air passage means and mixes with the injected swirling air at a high flow rate of gaseous fuel; and an intermediate cylinder disposed coaxially of said inner and outer cylinders and adjacent to said inner cylinder so that a space defined between the intermediate cylinder and said inner cylinder is smaller than a space defined between the intermediate cylinder and said outer cylinder, each of said inner and intermediate cylinders having through holes for defining said fuel inlet port means.

5. A combustor for a gas turbine comprising:

an inner cylinder with a plurality of louvers including a small diameter portion for defining a head combustion chamber and a large diameter portion for defining a main combustion chamber;

an outer cylinder surrounding said inner cylinder, said inner cylinder and said outer cylinder defining therebetween an air passage means for communicating with said head and main combustion chambers through said louvers;

a first burner mounted on one end of said head combustion chamber for supplying air and fuel into said head combustion chamber to effect combustion therein to form combustion flames;

a second burner mounted on a portion of said inner cylinder radially extending from said small diameter portion to said large diameter portion, said second burner comprising an inner cylindrical portion coaxial with said inner cylinder and an outer cylindrical portion radially spaced from said inner cylindrical portion to form an axially extending annular air passage;

a plurality of vanes disposed in said annular air passage for forming a plurality of air inlet ports, each of said vanes being axially inclined and being adapted to swirl air passing therethrough;

a fuel reservoir disposed inside said inner cylindrical portion; and a plurality of fuel passages formed in said inner cylindrical portion between said vanes to thereby supply gaseous fuel into said air passage.

6. A combustor for a gas turbine comprising;

an inner cylinder with a plurality of louvers including a small diameter portion for defining a head combustion chamber and a large diameter portion for defining a main combustion chamber;

an outer cylinder surrounding said inner cylinder, said inner cylinder and said outer cylinder defining therebetween an air passage means for communicating with said head and main combustion chambers through said louvers;

a first burner mounted on one end of said head combustion chamber for supplying air and fuel into said head combustion chamber to effect combustion therein to form combustion flames;

a second burner mounted on a portion of said inner cylinder radially extending from said small diameter portion to said large diameter portion, said second burner comprising an inner cylindrical portion coaxial with said inner cylinder and outer cylinderical portion radially spaced from said inner cylindrical portion to form an axially extending annular air passage;

a plurality of vanes disposed in said annular air passage for forming a plurality of air inlet ports, each of said vanes being axially inclined and being adapted to swirl air passing therethrough;

a fuel reservoir disposed inside said inner cylindrical portion;

a plurality of fuel passages formed in said inner cylindrical portion between said vanes to thereby supply gaseous fuel into said air passage; and a partition disposed between said inner and outer cylindrical portions to divide each of said air inlet ports into an inner side air inlet port and an outer side air inlet port greater in area than said inner side air inlet port, said partition having through holes between said vanes whereby a gaseous fuel from said fuel reservior is supplied into said outer side air inlet ports.

* * * * *